US007568315B2

(12) United States Patent
Norwood

(10) Patent No.: US 7,568,315 B2
(45) **Date of Patent: *Aug. 4, 2009**

(54) MOBILE CELLULAR TELEPHONE TOWER

(75) Inventor: Rodney Earl Norwood, Pleasanton, CA (US)

(73) Assignee: AT&T Intellectual Property I, LP, Reno, NV (US)

( * ) Notice: Subject to any disclaimer, the term of this patent is extended or adjusted under 35 U.S.C. 154(b) by 688 days.

This patent is subject to a terminal disclaimer.

(21) Appl. No.: 11/230,398

(22) Filed: Sep. 20, 2005

(65) Prior Publication Data

US 2006/0028390 A1 Feb. 9, 2006

Related U.S. Application Data

(63) Continuation of application No. 10/005,391, filed on Dec. 5, 2001, now Pat. No. 7,231,741.

(60) Provisional application No. 60/280,578, filed on Mar. 30, 2001.

(51) Int. Cl.
*E04B 9/00* (2006.01)

(52) U.S. Cl. ..... 52/118; 52/121; 52/126.6

(58) Field of Classification Search ..... 52/118, 52/121, 111, 126.6, 79.5
See application file for complete search history.

(56) References Cited

U.S. PATENT DOCUMENTS

| | | | | | |
|---|---|---|---|---|---|
| 1,299,261 | A * | 4/1919 | Taylor | 52/745.18 |
| 2,942,700 | A * | 6/1960 | Parmenter et al. | 52/121 |
| 3,109,522 | A * | 11/1963 | Womack et al. | 52/118 |
| 3,185,265 | A * | 5/1965 | White | 52/111 |
| 3,328,921 | A * | 7/1967 | Keslin | 52/121 |
| 4,785,309 | A * | 11/1988 | Gremillion | 343/883 |
| 5,101,215 | A * | 3/1992 | Creaser, Jr. | 343/883 |
| 5,450,695 | A * | 9/1995 | Desai | 52/118 |
| 5,786,854 | A * | 7/1998 | Slade et al. | 348/373 |
| 7,231,741 | B2 * | 6/2007 | Norwood | 52/118 |

* cited by examiner

*Primary Examiner*—Basil Katcheves
(74) *Attorney, Agent, or Firm*—Larson Newman & Abel, LLP

(57) ABSTRACT

A mobile cellular telephone tower comprises a self-propelled base and a tower connected to the base. The tower includes a base segment and at least a first extendable segment operatively connected to a second extendable segment. A winch is connected to the base, and a first cable is connected between the base segment and the first extendable segment to extend the first extendable segment. A second cable is connected between the winch and the second extendable segment to retract the second extendable segment. Cellular telephone network testing equipment mounted on the tower.

16 Claims, 3 Drawing Sheets

MOBILE CELLULAR TELEPHONE TOWER

RELATED APPLICATION

This application claims priority to U.S. Patent Application Ser. No. 60/280,578 filed on Mar. 30, 2001 entitled "MOBILE CELLULAR TELEPHONE TOWER" by Rodney E. Norwood, the entire disclosure of which is incorporated by reference, herein. This application further claims priority to U.S. patent application Ser. No. 10/005,391 filed Dec. 5, 2001 as a continuation application.

TECHNICAL FIELD OF THE INVENTION

This invention generally relates to cellular telephone networks, and more particularly to a mobile cellular telephone tower.

BACKGROUND OF THE INVENTION

Cellular telephones are increasingly popular. In general, a cellular telephone communicates with a stationary local tower, which in turn connects the call to a conventional telephone network. When it becomes necessary to expand cellular coverage to a new area, it is often desirable to test certain operations before erecting a permanent cellular tower. This pre-construction testing normally involves raising cellular transceiver equipment to heights of 80 feet or more.

One method of accomplishing this involves the use of a crane. The crane can be towed or driven to the test site, and used to hoist the testing equipment to the required height. In a similar method, a prefabricated trailer with an erectable antenna can be towed to the test site. U.S. Pat. No. 4,912,893, for example, shows a transportable cellular mobile radiotelephone site which includes an edifice that requires a portable crane to remove it from a truck on which it is delivered.

There are significant drawbacks to both of the conventional approaches. Often, the designated location is too small to accommodate a crane or trailer. In other instances, the designated site may not be accessible by road. In the case of unimproved locations, mud, steep grades or low laying foliage may make it difficult or impossible for a crane or trailer to negotiate.

SUMMARY OF THE INVENTION

The present invention is a mobile cellular telephone tower comprising a self-propelled base and a tower connected to the base. The tower includes a base segment and at least a first extendable segment operatively connected to a second extendable segment. A winch is connected to the base, and a first cable is connected between the base segment and the first extendable segment to extend the first extendable segment. A second cable is connected between the winch and the second extendable segment to retract the second extendable segment. Cellular telephone network testing equipment is mounted on the tower. Accordingly, it is an object of the present invention to provide a mobile cellular telephone tower of the type described above that can be deployed in locations that are relatively inaccessible.

Another object of the present invention is to provide a mobile cellular telephone tower of the type described above in which the tower segments are powered into both the extension and retraction directions.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
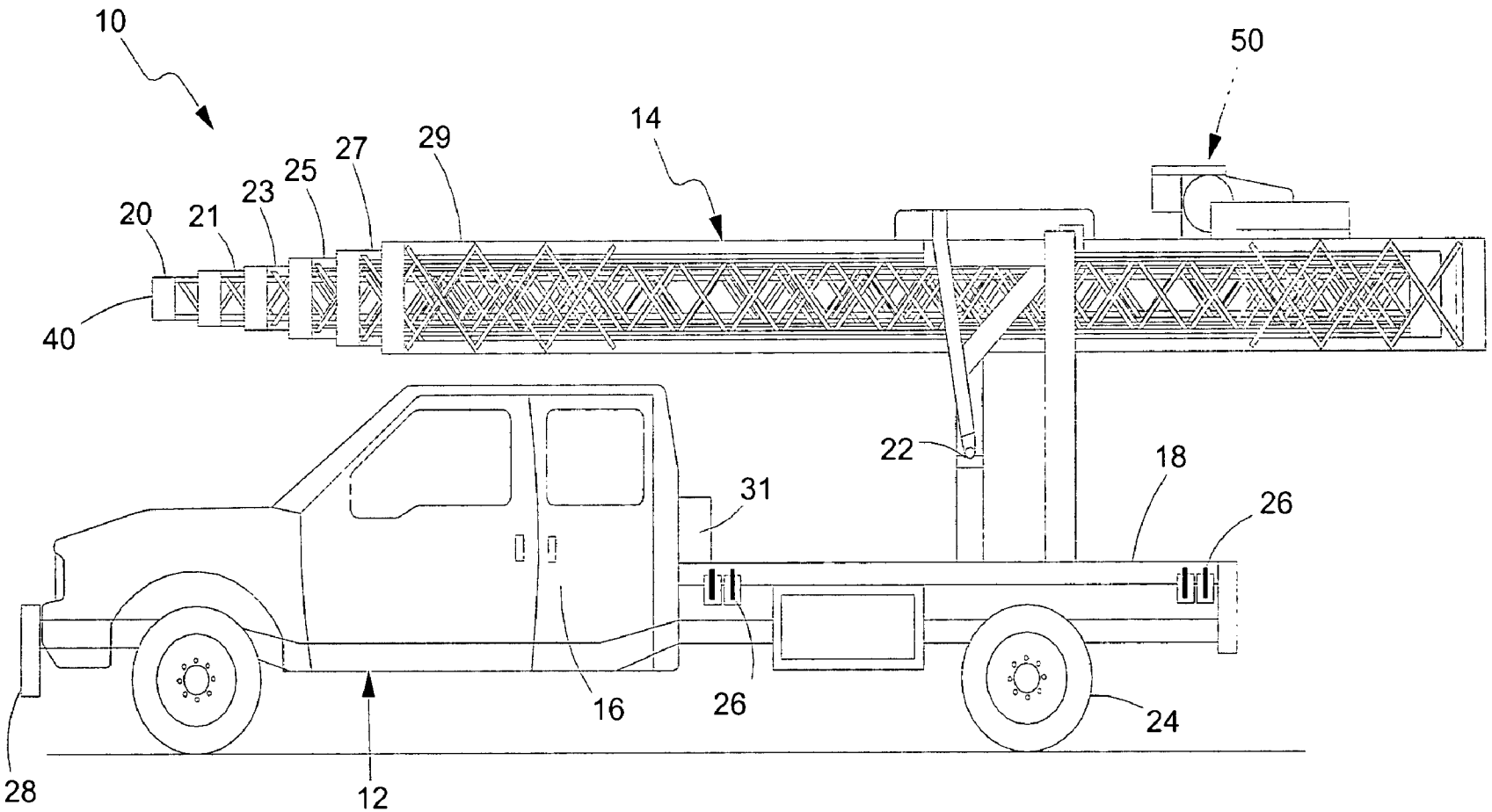
FIG. 1 is a side view of one embodiment of a mobile cellular telephone tower according to the present invention.
Figure 2:
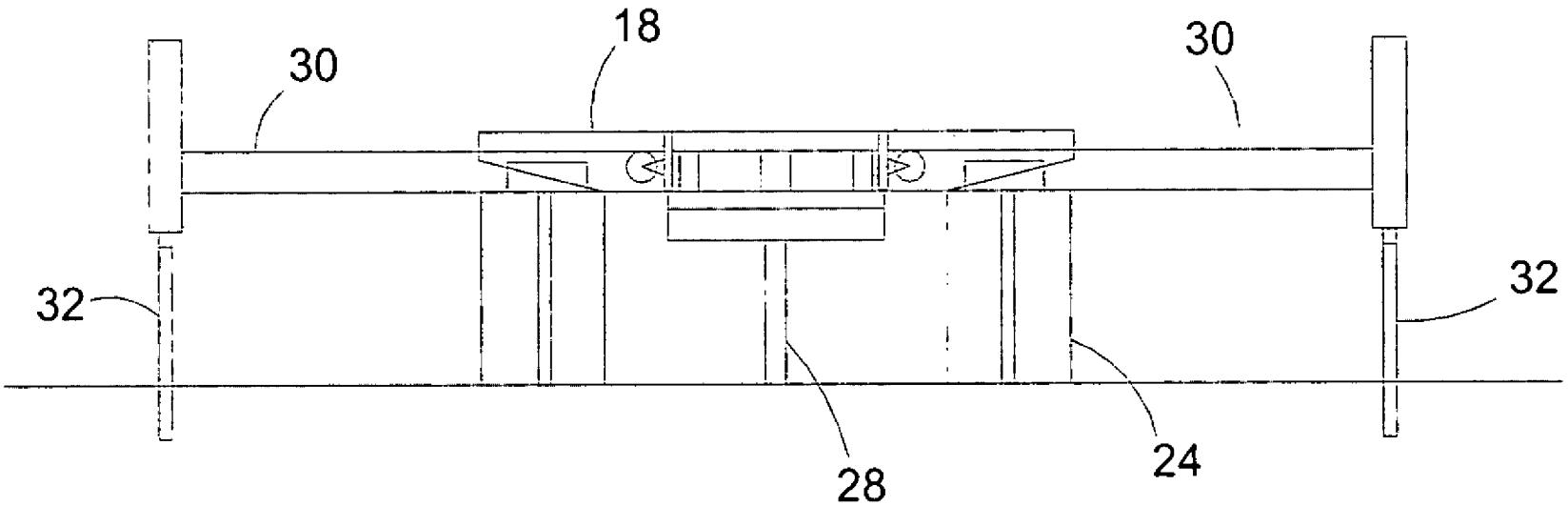
FIG. 2 is a rear view of a platform of the mobile cellular telephone tower with a series of outriggers in deployed positions.

FIGS. 1 and 2 show a mobile cellular telephone tower 10 comprising a self-propelled base 12 and a tower 14 connected to the base. In a preferred embodiment, the self-propelled base 12 is a four-wheel drive or all-wheel drive truck having an extended cab 16 for storing operating equipment and a rear platform 18.

The tower 14 includes a plurality of telescoping segments 20, 21, 23, 25, 27 and a base segment 29 which, when nested, are movable to a stored position generally horizontal and parallel with the platform 18, as shown in FIG. 1. An arm 22, which may be powered by a hydraulic or electric motor 31, is provided to pivot the tower 14 from the stored position to an operating position generally vertical and perpendicular to the platform 18. To best support the erect tower, the pivot point is advantageously selected to be close to or directly over the rear double wheels 24 of the base 12

It is preferable that the platform 18 be as level as possible before the tower 14 is erected. To this end, the self-propelled base 12 is provided with a plurality of stabilizing outriggers 26. The outriggers 26 are positioned around the base of the tower 14. In the embodiment shown, two outriggers 26 are placed on each side of the base 12, with one outrigger of each lateral pair positioned in front of the rear wheels 24, and one outrigger of each lateral pair positioned behind the wheels 24. It is also advantageous to provide one or more outriggers 28 proximate the forward most end of the base 12. Because of their distance from the pivot point, the outriggers 28 allow additional control to ensure that the platform 18 is level.

All of the outriggers are preferably welded or otherwise attached to the frame or subframe of the self-propelled base 12. The front outriggers 28 may be welded to the front bumper of the vehicle if the bumper is capable of bearing the loads. As shown in FIG. 2, all of the outriggers include a telescoping horizontal member 30 and a telescoping vertical member 32. The horizontal members 30 and the vertical members 32 may be hydraulically, electrically or manually extended and retracted.

After the self-propelled base 12 is driven to the desired test location, a power takeoff provides most necessary power. A six kilovolt diesel generator carried with the base is started to provide power to the electronics, as well as back up power for other functions. The base 12 is leveled with the outriggers, and cellular telephone network testing equipment such as a pod 40 containing an antenna and a continuous wave transmitter with an unmodulated signal is attached to the distal end 40 of the tower 14. The motor 31 then pivots the tower to the vertical position, so that the generally triangular in cross-section segments of the tower can be extended.

Figure 3:
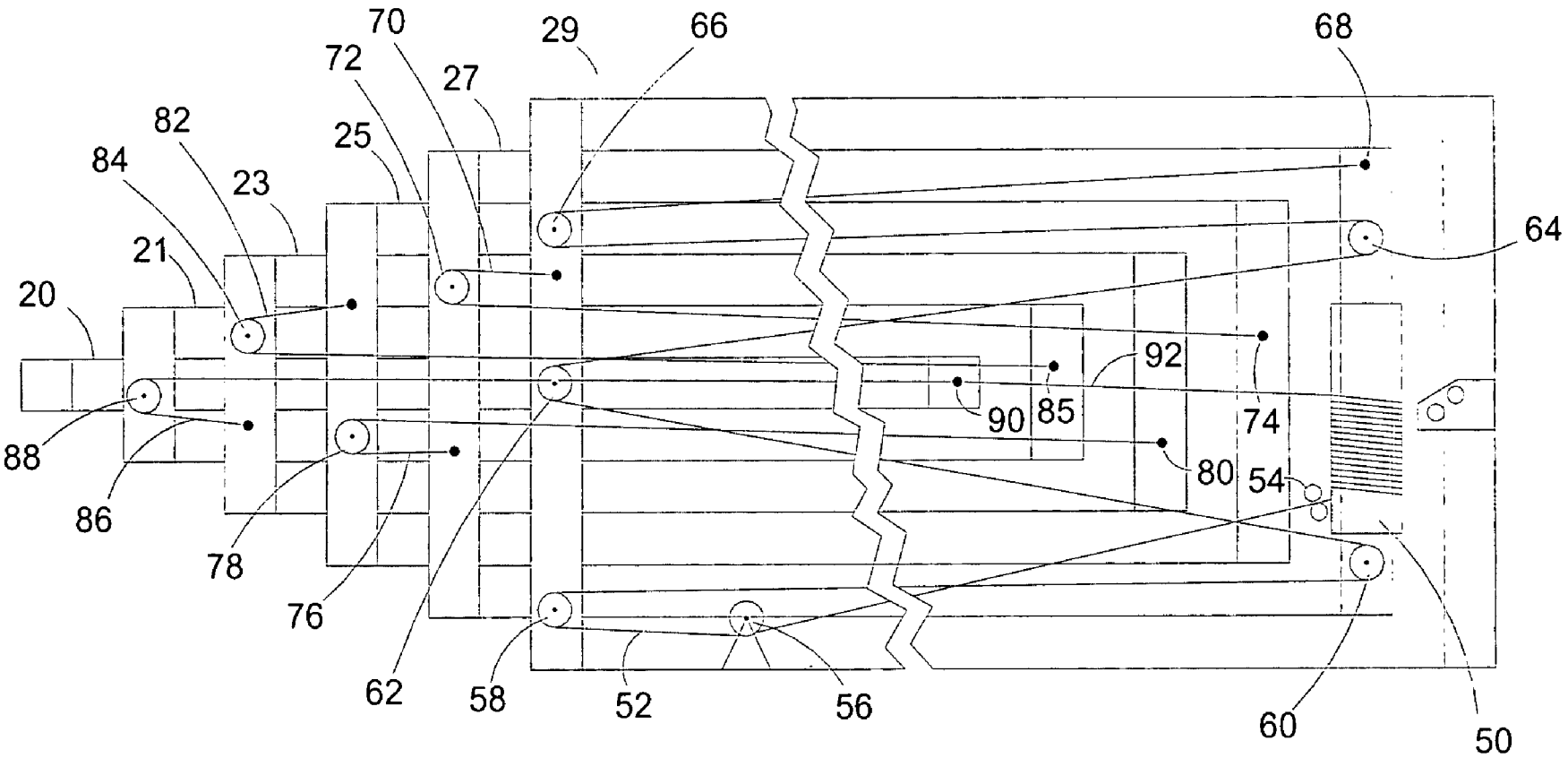
FIG. 3 is a schematic view of a winch mechanism for use with the mobile cellular telephone tower.

As shown in FIG. 3, a winch 50 having cables connected to each of the segments is energized to extend all of the segments simultaneously. The winch is situated on the outside of the outermost tower segment 29 above a lower end cap thereof. A main cable 52 winds off the winch 50 through a guide mechanism 54, around a pulley 56 situated on the side of tower segment 29, over a pulley 58 situated on an upper end cap of the segment 29, down and around a pulley 60 on a lower end cap of the first extendable segment 27, back up and around a pulley 62 on the upper end cap of the segment 29, back down and around a pulley 64 on the lower end cap of the segment 27, up and around a pulley 66 on the upper end cap of the segment 29, and finally down to an anchor point 68 on the lower end cap of the segment 27.

A series of fixed-length cables interconnect the tower segments. One of these cables 70 is anchored to the upper end cap of the segment 29, extends around a pulley 72 on the upper end cap of the segment 27, and terminates at an anchor point 74 on the lower end cap of the segment 25. A second fixed-length cable 76 is anchored to the upper end cap of the segment 27, extends around a pulley 78 on the upper end cap of the segment 25, and terminates at an anchor point 80 on the lower end cap of the segment 23. A third fixed-length cable 82 is anchored to the upper end cap of the segment 25, extends around a pulley 84 on the upper end cap of the segment 23, and terminates at an anchor point 85 on the lower end cap of the segment 21. A fourth fixed-length cable 86 is anchored to the upper end cap of the segment 23, extends around a pulley 88 on the upper end cap of the segment 21, and terminates at an anchor point 90 on the lower end cap of the segment 20. Redundant cables may be provided for some or all of these cables in cases, for instance, where it is necessary to balance the forces developed among the tower segments.

The tower segments are extended by powering the winch 50 to take up the deployed part or slack of the cable 52, and thereby draw the lower part of the tower segment 27 toward the upper part of the segment 29. As is apparent, the fixed-length cables operate to extend the nested tower segments such that the narrowest, innermost segment 20 reaches the greatest extension, and so on in turn for the increasingly wider segments 21, 23, 25 and 27. Thus, the top of the segment 27 pulls the bottom of the segment 25 by means of the cable 70. The top of the segment 25 similarly pulls the bottom of the segment 23 by means of the cable 76, the top of the segment 23 pulls the bottom of the segment 21 via the cable 82, and the top of the segment 21 pulls the bottom of the segment 20 via the cable 86. The base segment 29 is fixed relative to the platform, and does not move when the winch 50 is powered. In a preferred embodiment, each of the six segments has a height of about twenty feet so that the tower reaches a total erected height of about one hundred and twenty feet. The temporary cellular telephone site can then remain in operation for as long as necessary.

When the time comes to deactivate the site, the process described above is reversed. The winch 50 is again energized, and winds in reverse to positively pull down the bottom of the segment 20 via a cable 92. The cable 92 can either be a section of a continuous main cable, or the cable 92 and the main cable 52 can be separately anchored to the winch 50. As the segment 20 is retracted, the other segments are also positively retracted, instead of merely being allowed to collapse under their own weight. This is desirable in many situations, such as in high winds or when a substantial buildup of ice has occurred on the tower segments. Positive pulldown helps eliminate binding of the tower segments that often occurs under such conditions. A positive pulldown mechanism that is suitable for the present application is model MDP-750, which may be used in conjunction with tower segments, limiters and other accessories all available from U.S. Tower of Visalis, Calif.

The mobile cellular telephone tower of the present invention thus allows very fast access to testing locations that were previously inaccessible. The present invention is also operable under conditions that were not previously suitable, and furthermore allows a quicker turnaround time for the testing of new sites.

While specific embodiments of the present invention have been shown and described, it will be apparent to those skilled in the art that the disclosed invention may be modified in numerous ways and may assume many embodiments other than those specifically set out and described above. Accordingly, the scope of the invention is indicated in the appended claims, and all changes that come within the meaning and range of equivalents are intended to be embraced therein.

What is claimed is:

1. A mobile cellular telephone tower, comprising:

a self-propelled base;

a cellular telephone tower connected to the self-propelled base, the cellular telephone tower including a base segment and plurality of extendable segments telescopically interconnected to the base segment; and a winch, wherein the winch is connected by a first cable to the base segment and a first extendable segment of the plurality of extendable segments;

wherein the winch is connected by a second cable to a second extendable segment of the plurality of extendable segments;

wherein the first extendable segment is connected by a third cable to a third extendable segment of the plurality of extendable segments;

wherein the base segment includes a first set of at least one pulley;

wherein the first extendable segment includes a second set of at least one pulley and a third set of at least one pulley; and wherein the first cable is wound around the winch, the first set of at least one pulley and the second set of at least one pulley; and wherein the third cable is wound around the third set of at least one pulley.

2. The mobile cellular telephone tower of claim 1, wherein the first cable and the second cable are connected as sections of a continuous main cable wound around the winch.

3. The mobile cellular telephone tower of claim 1, wherein the first cable and the second cable are separately wound around the winch.

4. The mobile cellular telephone tower of claim 1, wherein the winch is operable to move the cellular telephone tower between a stowed position and an operating position.

5. The mobile cellular telephone tower of claim 4, wherein the stowed position is defined as each extendable segment being in a retracted position relative to the base segment.

6. The mobile cellular telephone tower of claim 4, wherein the operating position is defined as each extendable segment being in an extended position relative to the base segment.

7. The mobile cellular telephone tower of claim 1, wherein the first cable is further anchored to the first extendable segment.

8. The mobile cellular telephone tower of claim 1, wherein the third cable is anchored to the base segment.

9. The mobile cellular telephone tower of claim 1, wherein the third cable is anchored to the third extendable segment.

10. The mobile cellular telephone tower of claim 1, wherein the second extendable segment includes a fourth set of at least one pulley; and wherein the second cable is wound around the winch and the fourth set of at least one pulley.

11. The mobile cellular telephone tower of claim 1, wherein the second extendable segment is connected to a third extendable segment of the plurality of extendable segments.

12. The mobile cellular telephone tower of claim 11, wherein the second extendable segment includes a fourth set of at least one pulley;

wherein the second cable is wound around the winch and the fourth set of at least one pulley; and wherein the second cable is further anchored to the third extendable segment of the plurality of extendable segments.

13. The mobile cellular telephone tower of claim 1, wherein a third extendable segment is connected by a fourth cable to a fourth extendable segment of the plurality of extendable segments.

14. The mobile cellular telephone tower of claim 13, wherein the fourth cable is anchored to the fourth extendable segment.

15. A mobile cellular telephone tower, comprising:

a self-propelled base;

a cellular telephone tower connected to the self-propelled base, the cellular telephone tower including a base segment and plurality of extendable segments telescopically interconnected to the base segment; and a winch, wherein the winch is connected by a first cable to the base segment and a first extendable segment of the plurality of extendable segments;

wherein the winch is connected by a second cable to a second extendable segment of the plurality of extendable segments;

wherein the second extendable segment includes a first set of at least one pulley;

wherein the second cable is wound around the winch and the first set of at least one pulley;

wherein the second cable is further anchored to a third extendable segment of the plurality of extendable segments;

wherein the third extendable segment includes a second set of at least one pulley; and wherein the third cable is wound around the second set of at least one pulley.

16. The mobile cellular telephone tower of claim 15, wherein the third cable is further anchored to a fourth extendable segment.

* * * * *